US012799417B2

(12) United States Patent
Kuzuoka et al.

(10) Patent No.: US 12,799,417 B2
(45) Date of Patent: Nov. 17, 2026

(54) METHOD FOR PRODUCING GASOLINE ALTERNATIVE AND GASOLINE ALTERNATIVE

(71) Applicant: Honda Motor Co., Ltd., Tokyo (JP)

(72) Inventors: Kohei Kuzuoka, Wako (JP); Masayuki Nakatsu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 18/372,758

(22) Filed: Sep. 26, 2023

(65) Prior Publication Data

US 2024/0110113 A1 Apr. 4, 2024

(30) Foreign Application Priority Data

Sep. 30, 2022 (JP) ..... 2022-158404

(51) Int. Cl.
*C10L 1/02* (2006.01)

(52) U.S. Cl.
CPC ..... *C10L 1/023* (2013.01); *C10L 2200/0415* (2013.01); *C10L 2200/0469* (2013.01); *C10L 2200/0492* (2013.01)

(58) Field of Classification Search
CPC .... C10L 1/023; C10L 1/06; C10L 2200/0415; C10L 2200/0469; C10L 2200/0492
See application file for complete search history.

(56) References Cited

U.S. PATENT DOCUMENTS

2009/0193711 A1* 8/2009 Clark ..... C10L 1/023 44/451
2018/0346837 A1* 12/2018 Abdul-Manan ..... C10L 1/1832

FOREIGN PATENT DOCUMENTS

JP 2007270091 A 10/2007
JP 2011509324 A 3/2011

OTHER PUBLICATIONS

Japanese office action; Application 2022-158404; Aug. 6, 2024.

* cited by examiner

*Primary Examiner* — Latosha Hines
(74) *Attorney, Agent, or Firm* — Duft & Bornsen, PC

(57) ABSTRACT

A method for producing a gasoline alternative by mixing FT light naphtha obtained through Fischer-Tropsch synthesis using renewable power with bioalcohol obtained from biomass, includes: determining a mixing ratio of the bioalcohol to the FT light naphtha based on an octane value of the FT light naphtha, a blending octane value of the bioalcohol, and a predetermined target octane value; determining a hydrogenation ratio for hydrogenation of olefin contained in the FT light naphtha to paraffin such that the gasoline alternative has an olefin content ratio of 10 vol % or less based on the determined mixing ratio of the bioalcohol and an olefin content ratio of the FT light naphtha; hydrogenating the FT light naphtha according to the determined hydrogenation ratio; and mixing the bioalcohol with the hydrogenated FT light naphtha according to the determined mixing ratio of the bioalcohol.

2 Claims, 7 Drawing Sheets

| | CARBON INTENSITY [g/mile] |
|---|---|
| GASOLINE (DERIVED FROM FOSSIL FUEL) | 220 |
| FT LIGHT NAPHTHA (E-FUEL) | 1 |
| BIOETHANOL (DERIVED FROM CORN) | 161 |
| BIOETHANOL (DERIVED FROM SUGARCANE) | 73 |

METHOD FOR PRODUCING GASOLINE ALTERNATIVE AND GASOLINE ALTERNATIVE

CROSS-REFERENCE TO RELATED APPLICATION

This application is based upon and claims the benefit of priority from Japanese Patent Application No. 2022-158404 filed on Sep. 30, 2022, the content of which is incorporated herein by reference.

BACKGROUND OF THE INVENTION

Field of the Invention

This invention relates to a method for producing gasoline alternative using renewable energy and a gasoline alternative.

Description of the Related Art

Conventionally, some fuel compositions are known as gasoline alternatives (see JP 2007-270091 A, for example) The fuel composition described in JP 2007-270091 A has a research octane value of 89.0 or more, and contains A ($50 \geq A \geq 0$) volume % FT synthetic base material obtained from natural gas, petroleum liquefied gas, or the like, B ($25 \geq B \geq 0$) volume % ether with four to eight carbon atoms, and C ($15 \geq C \geq 0$) volume % alcohol with two to four carbon atoms ($B+C \geq 0$, $A \geq B+C$).

However, with the fuel composition described in JP 2007-270091 A, in which fossil fuels are used as raw materials, it is difficult to reduce carbon emissions (carbon intensity) per unit energy of the finally produced fuel. From the viewpoint of contribution to climate change mitigation or impact reduction, it is desirable to reduce the consumption of fossil fuels with high carbon intensity.

SUMMARY OF THE INVENTION

An aspect of the present invention is a method for producing a gasoline alternative by mixing FT light naphtha obtained through Fischer-Tropsch synthesis using renewable power with bioalcohol obtained from biomass. The method includes: determining a mixing ratio of the bioalcohol to the FT light naphtha based on an octane value of the FT light naphtha, a blending octane value of the bioalcohol, and a predetermined target octane value; determining a hydrogenation ratio for hydrogenation of olefin contained in the FT light naphtha to paraffin such that the gasoline alternative has an olefin content ratio of 10 vol % or less based on the determined mixing ratio of the bioalcohol and an olefin content ratio of the FT light naphtha; hydrogenating the FT light naphtha according to the determined hydrogenation ratio; and mixing the bioalcohol with the hydrogenated FT light naphtha according to the determined mixing ratio of the bioalcohol.

Another aspect of the present invention is a gasoline alternative, containing: FT light naphtha derived from renewable energy; and bioalcohol. An olefin content ratio of the gasoline alternative is 10 vol % or less. A content ratio of the bioalcohol to the FT light naphtha is determined based on an octane value of the FT light naphtha, a blending octane value of the bioalcohol, and a predetermined target octane value.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Hereinafter, an embodiment of the present invention will be described with reference to FIGS. 1 to 10. With the method for producing a gasoline alternative according to an embodiment of the present invention, a gasoline alternative with low carbon intensity and an octane value equivalent to that of gasoline is produced by reforming FT light naphtha with a low octane value obtained through Fischer-Tropsch synthesis using renewable power. In particular, a gasoline alternative with an extremely low carbon intensity is produced using FT light naphtha as a base material and mixing bioalcohol as an octane booster.

The average global temperature is maintained in a warm range suitable for organisms by greenhouse gases in the atmosphere. Specifically, part of the heat radiated from the ground surface heated by sunlight to outer space is absorbed by greenhouse gases and re-radiated to the ground surface, whereby the atmosphere is maintained in a warm state. Increasing concentrations of greenhouse gases in the atmosphere cause a rise in average global temperature (global warming).

Carbon dioxide is a greenhouse gas that greatly contributes to global warming, and its concentration in the atmosphere depends on the balance between carbon fixed on or in the ground in the form of plants or fossil fuels and carbon present in the atmosphere in the form of carbon dioxide. For example, carbon dioxide in the atmosphere is absorbed through photosynthesis in the growth process of plants, causing a decrease in the concentration of carbon dioxide in the atmosphere. Carbon dioxide is also released into the atmosphere through combustion of fossil fuels, causing an increase in the concentration of carbon dioxide in the atmosphere. In order to mitigate global warming, it is necessary to replace fossil fuels with renewable energy sources such as sunlight, wind power, water power, geothermal heat, or biomass to reduce carbon emissions.

Figure 1:
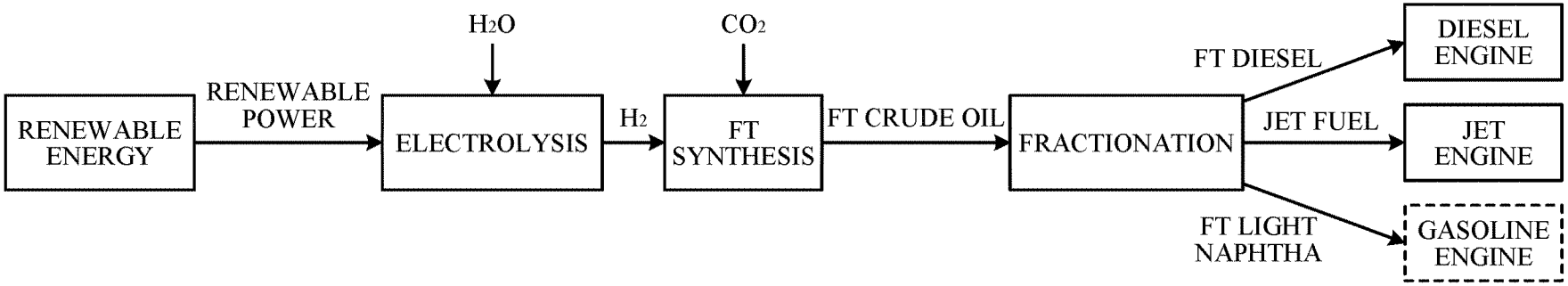
FIG. 1 is a diagram for explaining renewable fuels produced using renewable energy.

FIG. 1 is a diagram for explaining renewable fuels (e-fuels) produced using such renewable energy. As illustrated in FIG. 1, renewable power is generated by solar power generation, wind power generation, water power generation, geothermal power generation, or the like, and water is electrolyzed by renewable power into renewable hydrogen. Further, using renewable hydrogen and carbon dioxide recovered from factory exhaust gases and the like, Fischer-Tropsch (FT) crude oil is generated as an e-fuel through FT synthesis.

FT crude oil contains various components, given the principles of the FT synthesis process as a polymerization reaction. Such FT crude oil can be fractionated according to the range of boiling points and separated into FT diesel, jet fuel, and FT light naphtha as e-fuels. Among them, FT diesel and jet fuel can be directly used as a fuel for diesel engines and a fuel for jet engines, respectively.

FT light naphtha mainly contains chain saturated hydrocarbons (normal paraffins) with about six to ten carbon atoms. In addition, FT light naphtha accessorily contains unsaturated hydrocarbons (olefins), aromatic hydrocarbons (aromas), and the like at a content ratio that depends on the catalyst, reaction temperature, reaction time, and the like used in the FT synthesis process. Such FT light naphtha is suitable as abase material for gasoline alternatives because its vapor pressure characteristic (vaporization characteristic) conforms to the gasoline standard. However, FT light naphtha has an octane value (research octane value) of about 60 to 70, which is lower than the gasoline standard (about 90). Therefore, the direct use of FT light naphtha as a fuel for gasoline engines may cause knocking that leads to impaired engine combustion performance.

Figure 2:
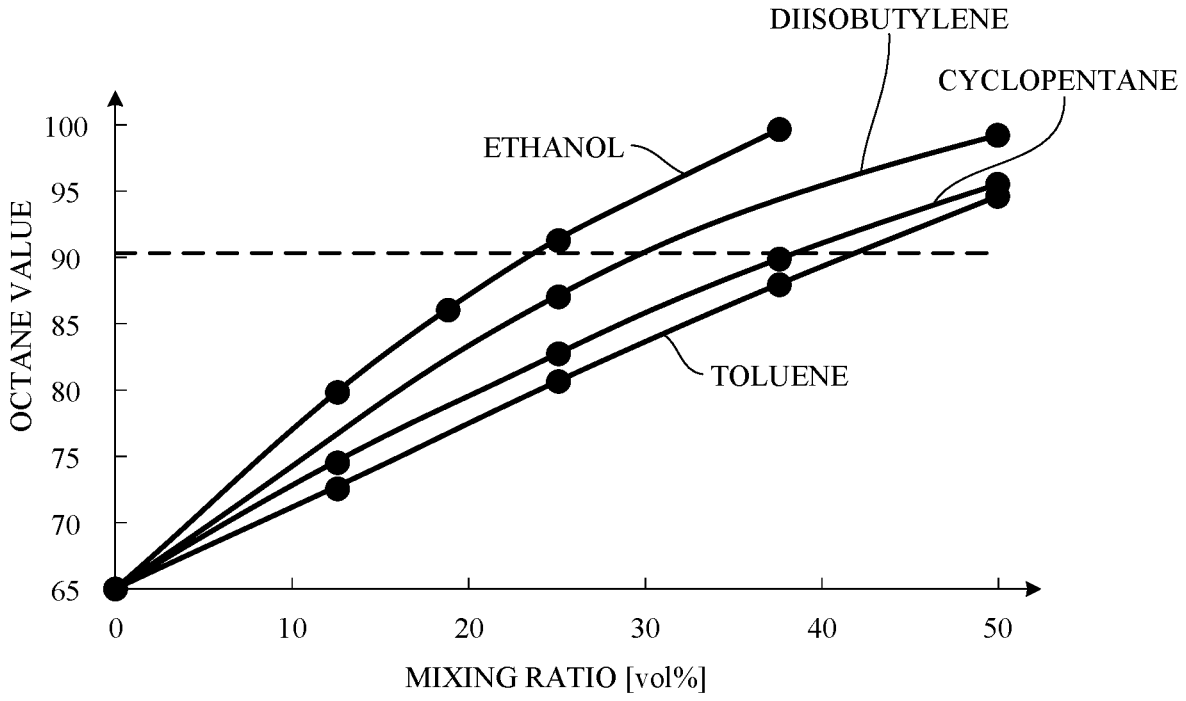
FIG. 2 is a diagram for explaining octane boosters.

FIG. 2 is a diagram for explaining octane boosters, showing example measurement results of the octane values of fuels obtained by mixing various octane boosters with FT light naphtha (base material) having an octane value of 65. As shown in FIG. 2, by using ethanol as an octane booster, a desired octane value (for example, about 90) can be achieved at a mixing ratio lower than that of other octane boosters (in FIG. 2, diisobutylene, cyclopentane, and toluene). In addition, ethanol has a high octane boosting rate (what is called blending octane value) in the region of small mixing ratios. In addition to ethanol, similar tendencies are observed in alcohols such as propanol and butanol.

Figures 3, 4:
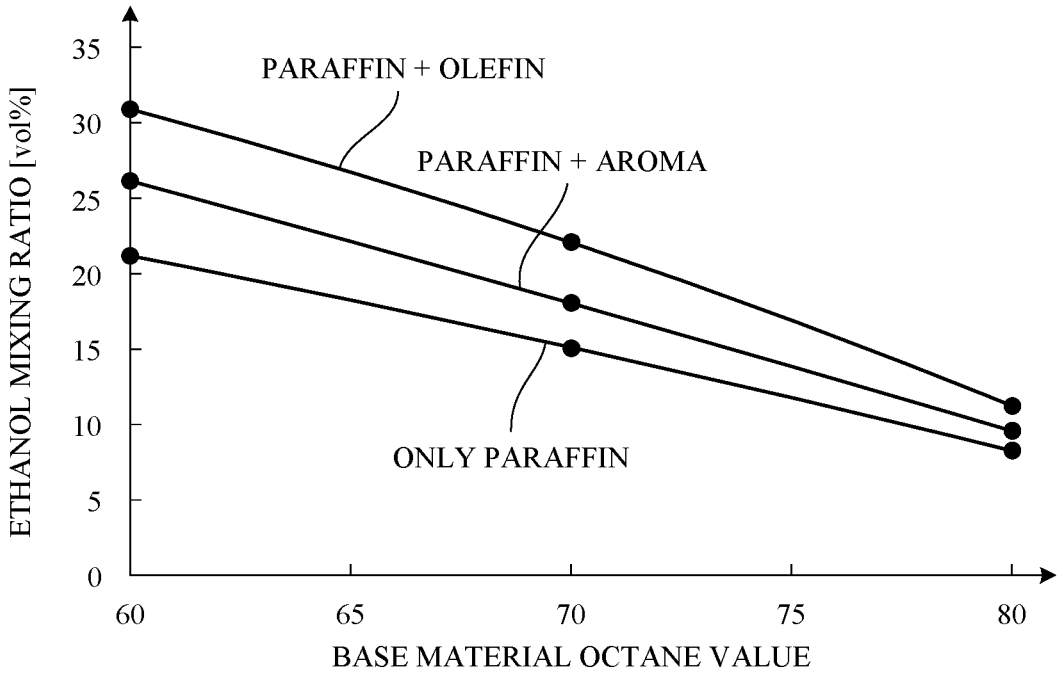
FIG. 3 is a diagram for explaining carbon intensities of fuels.
FIG. 4 is a diagram for explaining differences in octane boosting effect between different base material compositions.

FIG. 3 is a diagram for explaining the carbon intensity of fuels, showing examples of the carbon intensity in the case that various fuels are used as in-vehicle fuels. As shown in FIG. 3, the carbon intensity of FT light naphtha as an e-fuel is 1 g/mile, which is extremely lower than 220 g/mile, the carbon intensity of gasoline derived from fossil fuels. In addition, the carbon intensity of bioalcohols, for example, bioethanol, is 73 to 161 g/mile, which is lower than that of gasoline derived from fossil fuels but higher than that of FT light naphtha as an e-fuel.

Bioalcohol-mixed fuels obtained by mixing bioalcohols such as bioethanol with gasoline are spreading worldwide as in-vehicle fuels. In particular, bioethanol-mixed fuels have a high penetration rate and thus have high availability. Therefore, the present embodiment describes a method for producing a gasoline alternative with an octane value equivalent to that of gasoline and with an extremely low carbon intensity by reforming a base material of FT light naphtha as an e-fuel through mixing with bioalcohol.

FIG. 4 is a diagram for explaining differences in the effect of octane boosting between different base material compositions, showing examples of the mixing ratio of ethanol required to achieve an octane value of 90 (calculation results of chemical reaction analysis). As shown in FIG. 4, the mixing ratio of ethanol required to achieve an octane value of 90 becomes higher as the octane value of the base material decreases, regardless of base material composition. In addition, the base material accessorily containing aroma requires a higher mixing ratio of ethanol to achieve an octane value of 90 than the base material consisting only of the main component, namely paraffin. Furthermore, the base material accessorily containing olefin requires a higher mixing ratio of ethanol to achieve an octane value of 90 than the base material accessorily containing aroma. Similar tendencies are observed in propanol and butanol. This is because olefins and aromas inhibit the effect of octane boosting by alcohols such as ethanol.

Figure 5:
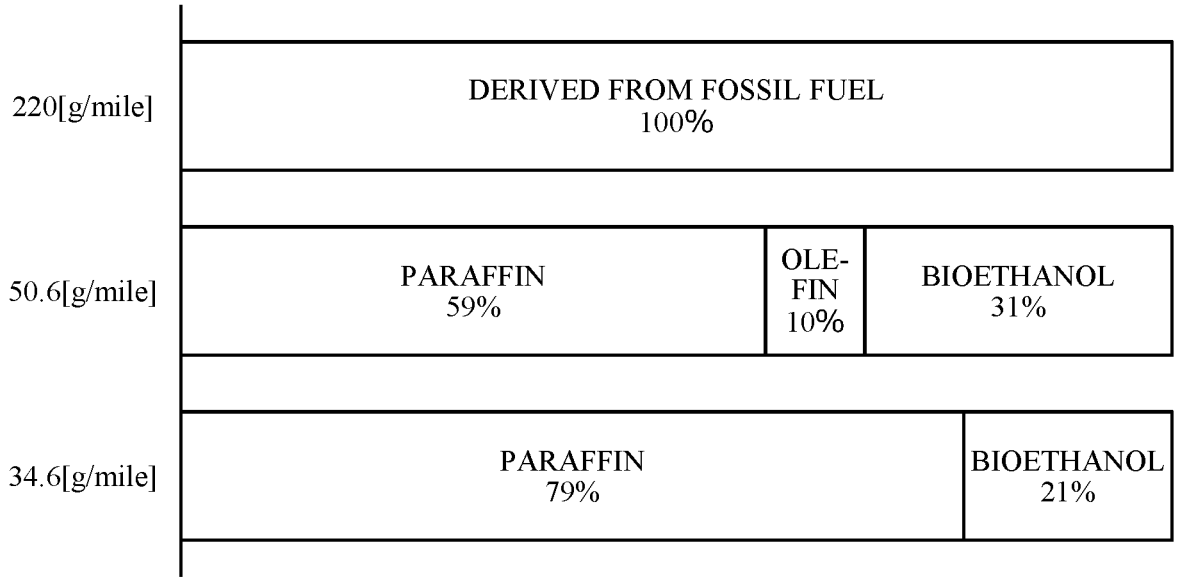
FIG. 5 is a diagram for explaining differences in carbon intensity between different fuel compositions.

FIG. 5 is a diagram for explaining differences in carbon intensity between different fuel compositions, showing examples of the carbon intensity of fuels having an octane value of 90. As shown in FIGS. 2 and 5, the carbon intensity of gasoline derived from fossil fuels is 220 g/mile. On the other hand, the carbon intensity of the fuel obtained by mixing 69 vol % e-fuel base material (that is, 59 (=69×85/100) vol % paraffin and 10 (=69×15/100) vol % olefin) containing 85 vol % paraffin and 15 vol % olefin and having an octane value of 60 with 31 vol % bioethanol (derived from corn) is 50.6 g/mile. Further, the carbon intensity of the fuel obtained by mixing 79 vol % e-fuel base material containing only paraffin and having an octane value of 60 with 21 vol % bioethanol (derived from corn) is 34.6 g/mile.

As described above, by preparing a base material with a reduced content ratio of olefin, which inhibits the effect of octane boosting by alcohols such as ethanol, the mixing ratio of alcohol required to achieve an octane value of 90 can be reduced, and the carbon intensity of the resultant fuel can be reduced. In the example of FIG. 5, by reducing the olefin content ratio of the base material from 15 vol % to 0 vol %, the carbon intensity of the resultant fuel is reduced by about 32% from 50.6 g/mile to 34.6 g/mile.

Olefins can be converted into paraffins (normal paraffins) through hydrogenation (decomposition reaction). Hydrogenation of olefins to paraffins proceeds at high temperature (about 200 to 430° C.), high pressure (about 70 to 210 kg/cm2), and in a hydrogen stream in the presence of a catalyst in which an active metal such as tungsten, iron, or nickel is supported on an acidic carrier such as silica or alumina. This reaction may be carried out in a fixed-bed reactor or in a fluidized-bed reactor. Hydrogenation of olefins to paraffins can use renewable hydrogen obtained through electrolysis of water with renewable power (FIG. 1), but requires additional energy input.

Figure 6:
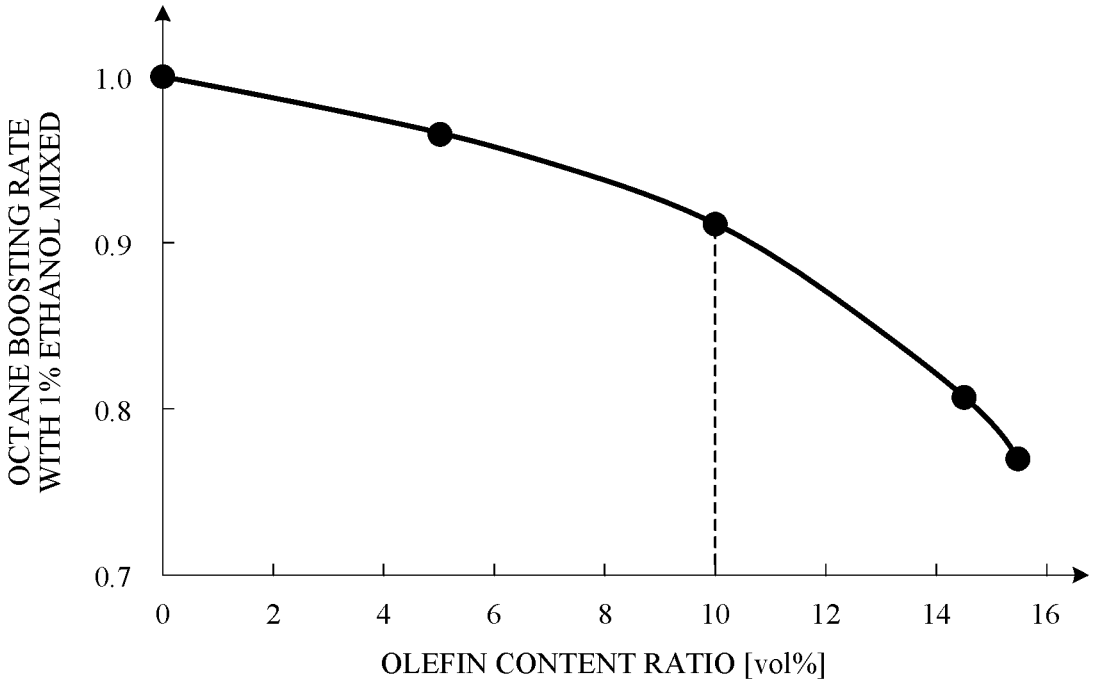
FIG. 6 is a diagram for explaining relationship between an olefin content ratio of the base material and an octane boosting rate.

FIG. 6 is a diagram for explaining the relationship between the olefin content ratio of the base material and the octane boosting rate, showing examples of the octane boosting rate (calculation results of chemical reaction analysis) in the case that 1 vol % ethanol is mixed with base materials having different olefin content ratios. More specifically, FIG. 6 shows the relative octane boosting rates at varying olefin content ratios of base materials, where the octane boosting rate ((octane value after ethanol mixing)/(octane value of base material)) in the case that ethanol is mixed with the base material having an olefin content ratio of 0 vol % is taken as "1".

As shown in FIG. 6, as the olefin content ratio of the base material increases, the octane boosting rate associated with mixing of ethanol decreases, and the reduction ratio of the octane boosting rate becomes larger. The reduction ratio of the octane boosting rate becomes larger as the olefin content ratio of the base material increases, with an inflection point at around 10 vol %. Similar tendencies are observed in propanol and butanol. Such tendencies can also be confirmed in actual experimental results. Considering the effect of octane boosting associated with mixing of alcohols such as ethanol and the additional energy input required for hydrogenation, it is preferable that the hydrogenation of olefins to paraffins be performed until the olefin content ratio becomes at least 10 vol % or less.

Olefins have low oxidation stability, and the gasoline standards (categories 3 to 6) of the International Organization of Motor Vehicle Manufacturers (OICA) specify that the olefin content ratio in in-vehicle fuels should be 10 vol % or less. Therefore, also from the viewpoint of oxidation stability of the fuel, it is preferable that the hydrogenation of olefins to paraffins be performed until the olefin content ratio becomes at least 10 vol % or less.

From normal paraffin, which is the main component of FT light naphtha as a base material, heavy components (paraffin wax) precipitate at low temperatures (about 5° C. or lower). Therefore, from the viewpoint of low-temperature performance of the fuel, it is preferable to convert a part of the normal paraffin through an isomerization reaction into isoparaffin, which is hardly crystallized. The isomerization of normal paraffin to isoparaffin improves the octane value of the entire base material according to the isomerization ratio. The ratio of isomerization of normal paraffin to isoparaffin is determined by equipment specifications, the amount of energy that can be input, cost, and the like.

Figure 7:
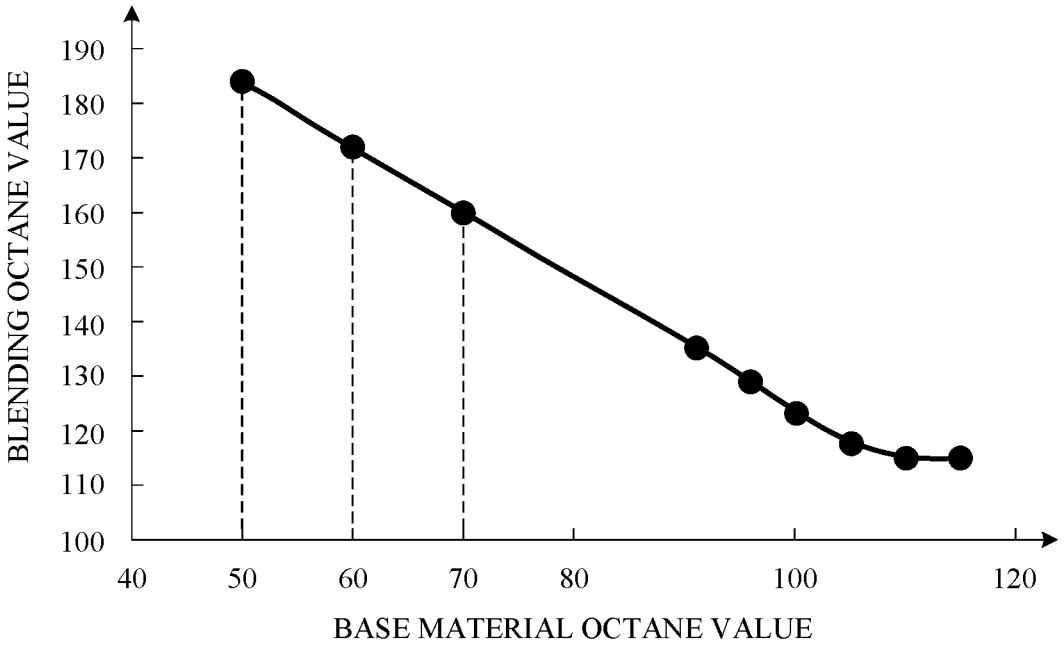
FIG. 7 is a diagram for explaining a blending octane value of alcohol.

FIG. 7 is a diagram for explaining the blending octane value of alcohol. FIG. 7 shows examples of the blending octane value based on calculation results of chemical reaction calculation and actual measurement results in the case that ethanol is mixed with base materials having different octane values and an olefin content ratio of 10 vol %. As shown in FIG. 7, in the region where the octane value of the base material is as low as about 50 to 100, the octane value obtained by mixing of ethanol increases as the octane value of the base material decreases. Similar tendencies are observed in propanol and butanol.

Figure 8:
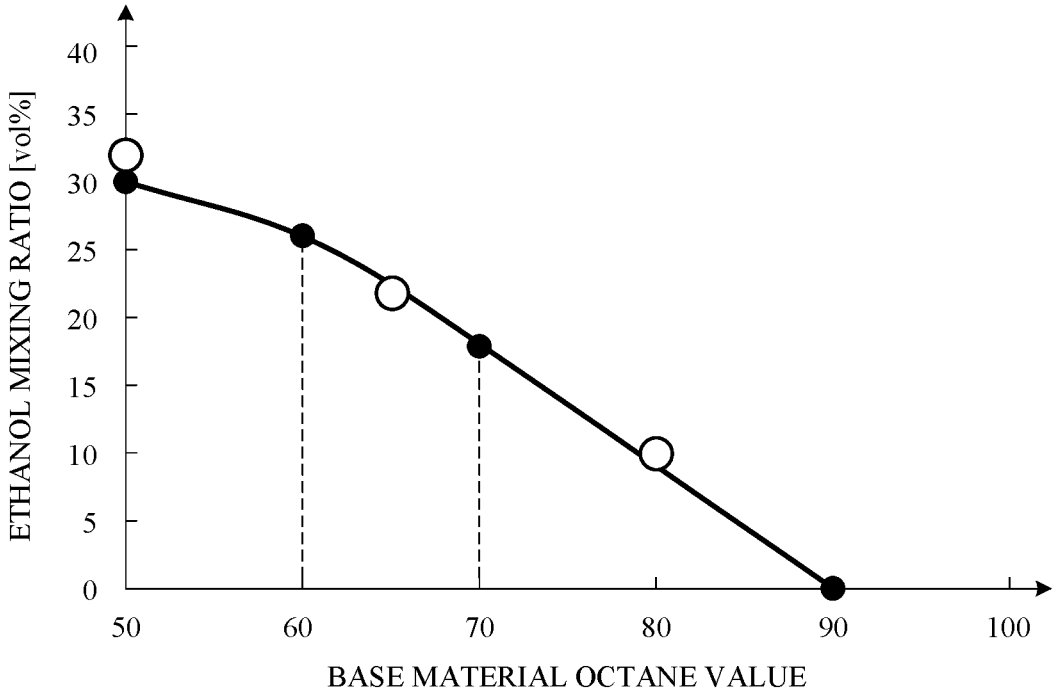
FIG. 8 is a diagram for explaining a mixing ratio of alcohol required to obtain a gasoline alternative.

FIG. 8 is a diagram for explaining the mixing ratio of alcohol required to obtain a gasoline alternative, showing examples of the mixing ratio of ethanol required to achieve an octane value of 90. In FIG. 8, calculation results of the mixing ratio b of ethanol calculated with Formula (i) below based on the blending octane value in FIG. 7 are indicated by black circles, and experimental results are indicated by white circles. In Formula (i), (1−b) represents the mixing ratio of base material. As shown in FIG. 8, the mixing ratio of ethanol required to achieve an octane value of 90 substantially matches the predicted value (solid line in FIG. 8) based on the blending octane value in FIG. 7.

(octane value of base material)×(mixing ratio of base material)+(blending octane value)×(mixing ratio of ethanol)=(desired octane value)(octane value of base material)(1−$b$)+(blending octane value) $b$=90 (i)

Because the octane value of the base material (FT light naphtha) is about 60 to 70, the mixing ratio of ethanol is 30 vol % or less as shown in FIG. 8. Therefore, the content ratio of base material (FT light naphtha) in the final gasoline alternative obtained by mixing ethanol with the base material is 70 vol % or more. Similar mixing ratios (30 vol % or less alcohol, 70 vol % or more base material (FT light naphtha)) are applied for mixing of other alcohols such as propanol and butanol, in addition to ethanol.

Figure 9:
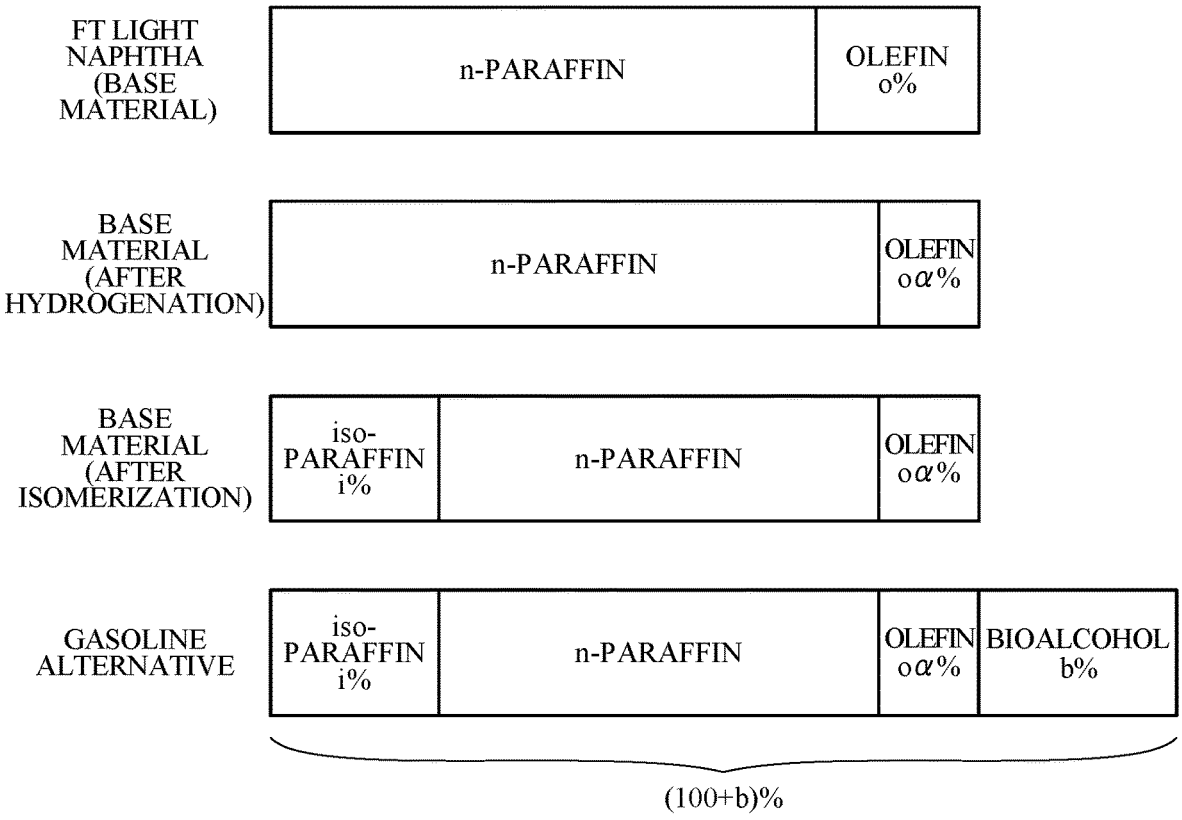
FIG. 9 is a diagram for explaining composition of a gasoline alternative according to an embodiment of the present invention.

FIG. 9 is a diagram for explaining the composition of a gasoline alternative according to the embodiment of the present invention. As shown in FIG. 9, FT light naphtha (base material) contains o vol % olefin in addition to the main component, normal paraffin. The olefin content ratio o vol % of the base material can be measured, for example, by analyzing the actual base material. After hydrogenation to hydrogenate a part of the olefin ((100−α) vol % of the olefin) to normal paraffin, the base material contains oα vol % olefin. Further, after isomerization to isomerize a part of the normal paraffin (i vol % of the entire base material) to isoparaffin, the base material contains i vol % isoparaffin.

The final gasoline alternative having a desired octane value (for example, an octane value of 90) contains b vol % bioalcohol (for example, bioethanol) with respect to the 100 vol % base material obtained as the result of the pretreatment (hydrogenation and isomerization). The mixing ratio b of bioalcohol to the base material can be calculated based on a predetermined characteristic such as that shown in FIG. 8. The octane value of the base material can be estimated through additive calculation based on the base material composition (carbon number distribution of normal paraffin or olefin content ratio) estimated according to the FT synthesis process or measured by analysis, the isomerization ratio determined according to equipment specifications, and the like.

The olefin content ratio of the final gasoline alternative is (oα/(100+b)). From the viewpoint of the effect of octane boosting associated with mixing of bioalcohol and the oxidation stability of the fuel, it is preferable to determine the hydrogenation ratio α of the base material such that Formula (ii) below is satisfied. It is preferable to determine the hydrogenation ratio α such that the left and right sides of Formula (ii) are equal, for example, in consideration of the balance with the input energy required for hydrogenation of the base material and the decrease in octane value due to excessive hydrogenation.

$$100o\alpha/(100+b)\leq 10 \quad \text{(ii)}$$

Figure 10:
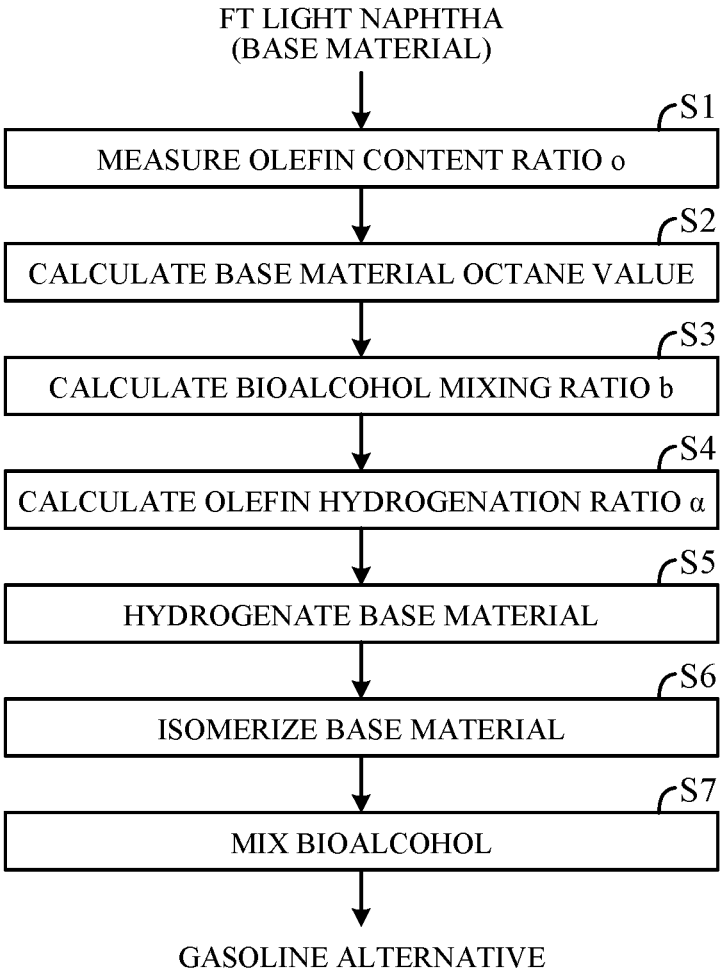
FIG. 10 is a diagram illustrating a method for producing the gasoline alternative according to the embodiment of the present invention.

FIG. 10 is a diagram illustrating a method for producing a gasoline alternative according to the embodiment of the present invention. As shown in FIG. 10, first, the olefin content ratio o of the base material is measured (step S1). Next, the octane value of the base material is calculated based on the olefin content ratio o of the base material measured in step S1 and the isomerization ratio i of the base material determined according to equipment specifications or the like (step S2). Next, an appropriate mixing ratio b of bioalcohol that depends on the octane value of the base material calculated in step S2 is calculated based on a predetermined characteristic such as that shown in FIG. 8 (step S3). More specifically, the octane value of the base material calculated in step S2, the blending octane value of bioalcohol corresponding to the octane value of the base material such as that shown in FIG. 7, and the octane value to be achieved (e.g. 90) are substituted into Formula (i). Then, the equation of Formula (i) is solved for the mixing ratio b of bioalcohol to calculate the mixing ratio b of bioalcohol and the mixing ratio (1-b) of base material.

(octane value of base material)×(mixing ratio of base material)+(blending octane value)×(mixing ratio of bioalcohol)=(desired octane value)(octane value of base material)(1−$b$)+(blending octane value)$b$=90 (i)

Next, based on the mixing ratio b of bioalcohol calculated in step S3 and the olefin content ratio o of the base material measured in step S1, the hydrogenation ratio α in the base material is calculated such that the gasoline alternative has an olefin content ratio of 10 vol % or less (step S4). Next, the base material containing olefin is hydrogenated according to the hydrogenation ratio α calculated in step S4 (step S5). Next, the base material hydrogenated in step S5 is further isomerized according to the predetermined isomerization ratio i (step S6). Next, bioalcohol is mixed with the base material isomerized in step S6 at the mixing ratio b calculated in step S3 (step S7). This completes the gasoline alternative.

According to the present embodiment, the following operations and effects are achievable.

(1) A method for producing a gasoline alternative by mixing FT light naphtha (base material) obtained through FT synthesis using renewable power with bioalcohol obtained from biomass, the method including: determining the mixing ratio b of bioalcohol to the base material based on the octane value of the base material, the blending octane value of bioalcohol, and a predetermined target octane value (steps S1 to S3); determining the hydrogenation ratio α for hydrogenation of olefin contained in the base material to paraffin such that the gasoline alternative has an olefin content ratio (oα/(100+b)) of 10 vol % or less based on the determined mixing ratio b of bioalcohol and the olefin content ratio o of the base material (step S4); hydrogenating the base material according to the determined hydrogenation ratio α (step S5); and mixing bioalcohol with the hydrogenated base material according to the determined mixing ratio b of bioalcohol (step S7) (FIG. 10).

In this manner, it is possible to produce a gasoline alternative with an octane value equivalent to that of gasoline and with an extremely low carbon intensity by mixing bioalcohol at an appropriate ratio with a base material of FT light naphtha as an e-fuel. In addition, by performing pretreatment to hydrogenate the base material and reduce the content ratio of olefin, which inhibits the effect of octane boosting, it is possible to reduce the mixing ratio of bioalcohol required to achieve an octane value equivalent to that of gasoline, and to further reduce the carbon intensity of the fuel (FIGS. 5 and 6).

(2) The method for producing a gasoline alternative further includes isomerizing normal paraffin contained in the hydrogenated base material to isoparaffin (step S6)(FIG. 10). Accordingly, the low-temperature performance of the fuel can be improved. In addition, the octane value is improved by isomerizing normal paraffin to isoparaffin, and the mixing ratio of bioalcohol required to achieve an octane value equivalent to that of gasoline is further reduced, so that the carbon intensity of the fuel can be further reduced.

(3) Bioalcohol is any of bioethanol, biopropanol, and biobutanol. For example, bioethanol, which has a high penetration rate and high availability, can be used as an octane booster.

(4) The gasoline alternative contains FT light naphtha (base material) derived from renewable energy, and bioalcohol (FIG. 1 and FIG. 9). The olefin content ratio of the gasoline alternative is 10 vol % or less. The content ratio of bioalcohol to the base material is determined based on the octane value of the base material, the blending octane value of bioalcohol, and a predetermined target octane value. By setting the olefin content ratio to 10 vol % or less, the content ratio of bioalcohol is minimized, and a gasoline alternative having an extremely low carbon intensity can be realized. Such fuels also conform to the gasoline standards on oxidation stability.

In the above embodiment, an example in which FT synthesis is performed using renewable hydrogen and carbon dioxide recovered from factory exhaust gases and the like has been described with reference to FIG. 1 and the like, but FT synthesis using renewable power is not limited to this example. For example, biomass, natural gas, coal, or the like may be used.

In the above embodiment, an example in which FT light naphtha with about six to ten carbon atoms is obtained from FT crude oil through fractionation has been described with reference to FIG. 1 and the like, but FT light naphtha obtained through FT synthesis is not limited to this example. For example, the conditions of the FT synthesis process may be adapted such that FT light naphtha with about six to ten carbon atoms can be obtained. In this case, the fractionation step is unnecessary.

In the above embodiment, an example in which the base material is isomerized and then mixed with bioalcohol has been described with reference to FIG. 10 and the like, but the method for producing a gasoline alternative is not limited to this example. For example, if it is not necessary to consider the low-temperature performance of the fuel, the isomerization step is unnecessary.

The above embodiment can be combined as desired with one or more of the aforesaid modifications. The modifications can also be combined with one another.

According to the present invention, it becomes possible to produce gasoline alternative with low carbon intensity.

Above, while the present invention has been described with reference to the preferred embodiments thereof, it will be understood, by those skilled in the art, that various changes and modifications may be made thereto without departing from the scope of the appended claims.

The invention claimed is:

1. A method for producing a gasoline alternative by mixing FT light naphtha obtained through Fischer-Tropsch synthesis using renewable power with bioalcohol obtained from biomass, the method comprising:

measuring an olefin content ratio of the FT light naphtha;

calculating an octane value of the FT light naphtha based on the olefin content ratio of the FT light naphtha and a predetermined isomerization ratio of the FT light naphtha;

determining a bioalcohol fraction in a mixture of the bioalcohol and the FT light naphtha based on the octane value of the FT light naphtha, a blending octane value of the bioalcohol corresponding to the octane value of the FT light naphtha, and a predetermined target octane value, and further based on a first equation comprising:

(the octane value of the FT light naphtha)(1−(the bioalcohol fraction))+(the blending octane value)(the bioalcohol fraction)=(the target octane value);

determining a hydrogenation ratio for hydrogenation of olefin contained in the FT light naphtha to paraffin such that the gasoline alternative has an olefin content ratio of 10 vol % or less based on the bioalcohol fraction and the olefin content ratio of the FT light naphtha, and further based on a second equation comprising:

100(the olefin content ratio of the FT light naphtha)(the hydrogenation ratio)/(100+(the bioalcohol fraction))≤10;

hydrogenating the FT light naphtha according to the hydrogenation ratio;

then isomerizing normal paraffin contained in the FT light naphtha hydrogenated to isoparaffin according to the predetermined isomerization ratio; and then mixing the bioalcohol with the FT light naphtha isomerized according to the bioalcohol fraction, wherein the bioalcohol fraction is 30 vol % or less.

2. The method according to claim 1, wherein the bioalcohol is any of bioethanol, biopropanol, and biobutanol.

* * * * *